US006367177B1

(12) United States Patent
Mullen

(10) Patent No.: US 6,367,177 B1
(45) Date of Patent: Apr. 9, 2002

(54) TRENCH RESTORATION APPARATUS

(76) Inventor: Richard Mullen, 235 Princeton Ave., Brick, NJ (US) 08724

( * ) Notice: Subject to any disclaimer, the term of this patent is extended or adjusted under 35 U.S.C. 154(b) by 0 days.

(21) Appl. No.: 09/464,726

(22) Filed: Dec. 16, 1999

(51) Int. Cl.[7] ..... E02F 3/815
(52) U.S. Cl. ..... 37/407; 172/245
(58) Field of Search ..... 37/403, 407, 408, 37/409, 903, 271, 274; 172/245, 252, 253; 414/912

(56) References Cited

U.S. PATENT DOCUMENTS 1,791,942 A * 2/1931 Symonds ..... 37/274
2,275,391 A * 3/1942 Lawler ..... 172/823
2,317,560 A * 4/1943 Stroup ..... 172/664
2,544,815 A * 3/1951 Weaver ..... 37/98
3,466,766 A * 9/1969 Kahlbacher ..... 37/233
4,189,854 A * 2/1980 Haynes ..... 37/117.5
4,249,323 A * 2/1981 Mathis et al. ..... 37/232
4,597,205 A * 7/1986 Guest ..... 37/241
4,813,164 A * 3/1989 Morrell ..... 37/117.5
5,241,763 A * 9/1993 Dynan ..... 37/407
5,273,375 A 12/1993 Plourde
5,724,755 A * 3/1998 Weagley ..... 37/233
5,806,213 A * 9/1998 Doornek et al. ..... 37/231
5,829,174 A * 11/1998 Hadler et al. ..... 37/234
5,860,230 A * 1/1999 Daniels ..... 37/232

* cited by examiner

*Primary Examiner*—Thomas B. Will
*Assistant Examiner*—Meredith C Petravick
(74) *Attorney, Agent, or Firm*—Rosenman & Colin LLP

(57) ABSTRACT

A trench leveling blade is movably mounted between a pair of side walls which are slotted to receive the bucket of a backhoe or other excavating machine. The blade is vertically adjustable with a hand operated jack screw. Rollers mounted in front and back of the blade support the blade during use and guide the blade during its vertical adjustment. A pair of adjustable scraper blades is provided on opposite sides of the leveling blade to clean the surface of the pavement adjoining the trench or any other surface being worked by the leveling blade.

19 Claims, 7 Drawing Sheets

TRENCH RESTORATION APPARATUS

BACKGROUND OF THE INVENTION

1. Field of the Invention

The present invention relates in general to highway construction equipment, and in particular to an attachment for a backhoe or other earthmoving machine for shaping a trench and/or plowing a base or paving material to a uniform depth.

2. Description of the Prior Developments

Various attachments have been available for forming trenches and ditches in connection with the construction and maintenance of roads and highways. Although these attachments perform satisfactorily in general, they are not particularly well suited for maintaining a uniform trench depth and width. Moreover, such attachments typically do not control the lateral movement of earth and other material as a ditch is being formed, and such attachments do not have the capability of accurately spreading a level layer of material within or above the surrounding road surface while maintaining clean sides for subsequent compaction by a roller.

Accordingly, a need exists for a trench forming apparatus which is of a relatively simple design, yet which can accurately maintain the relative depth of a trench within close limits.

A further need exists for such an apparatus which can direct plowed earth and material laterally inwardly toward a trench or laterally outwardly away from the trench as the height of the ditch is being plowed and conditioned.

Still a further need exists for such a trenching apparatus which has a vertically adjustable blade for accurately adjusting the height of a trench.

Yet a further need exists for a trench or road working apparatus which can level a trench at a height below the surrounding road surface, as well as spread material such as blacktop at a level above the surrounding road surface.

SUMMARY OF THE INVENTION

The present invention has been developed to fulfill the needs noted above and therefore has as an object the provision of a trench leveling and conditioning apparatus having a generally simple design yet which can accurately maintain the depth of a trench within close limits.

A further object of the invention is the provision of a trench conditioning apparatus which can be easily attached to a power machine such as a backhoe or wheel loader and which can control the placement of material moved along the trench.

Yet a further object of the invention is the provision of a trench conditioning apparatus having a central height-adjustable blade for setting a trench depth and a pair of adjustable side blades for controlling placement of earth and material located along the sides of a trench and for keeping the earth and material away from the wheels and skids of the apparatus.

A further object of the invention is to provide a trench and road conditioning apparatus which has a height adjustable blade for forming a level trench surface below the surrounding road surface, or spreading a level layer of road material at a height above the surrounding road surface.

These and other objects are met by the present invention which is directed to a trench conditioning apparatus having a pair of slotted side walls adapted to receive the bucket of a power machine such as a backhoe or wheel loader. A vertically adjustable central blade is supported between the side walls, and a pair of pivoting adjustable side blades is mounted to the side walls on opposite sides of the central blade.

The side blades can be pivoted in front of the central blade to laterally direct and plow earth and material into the path of the central blade, or pivoted in back of the central blade to laterally direct and plow earth and material away from the trench and the central blade. In either case, the side blades keep the existing paved edges of the road surface adjacent the trench clean and free of earth and material and thereby provide a clean surface over which the casters and skids of the apparatus and the wheels of the machine used to push it can move. This helps to keep the central blade level insofar as material passing under the wheels of the apparatus and machine used to push the apparatus tends to lift the central blade out of level alignment with the trench.

The invention can be used with trenches in virtually any condition, but is particularly adapted for use in trenches which have already been backfilled and compacted. When the trenching apparatus is then moved along such a preconditioned trench, an extremely smooth trench having an accurately selected height can be produced.

If desired, the central blade can be raised higher than the side blades and higher than the adjacent pavement over which the side blades ride. In this raised blade position, the trenching apparatus can be used to spread materials such as aggregates and/or blacktop at any desired height, even a height higher than the existing road to allow for subsequent height compaction when the aggregates and/or blacktop are rolled and compressed by a steamroller or other compaction machine. The range of height is from 14" below the road to 3" above the road.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like or similar parts.

DETAILED DESCRIPTION OF THE PREFERRED EMBODIMENTS

Figure 1:
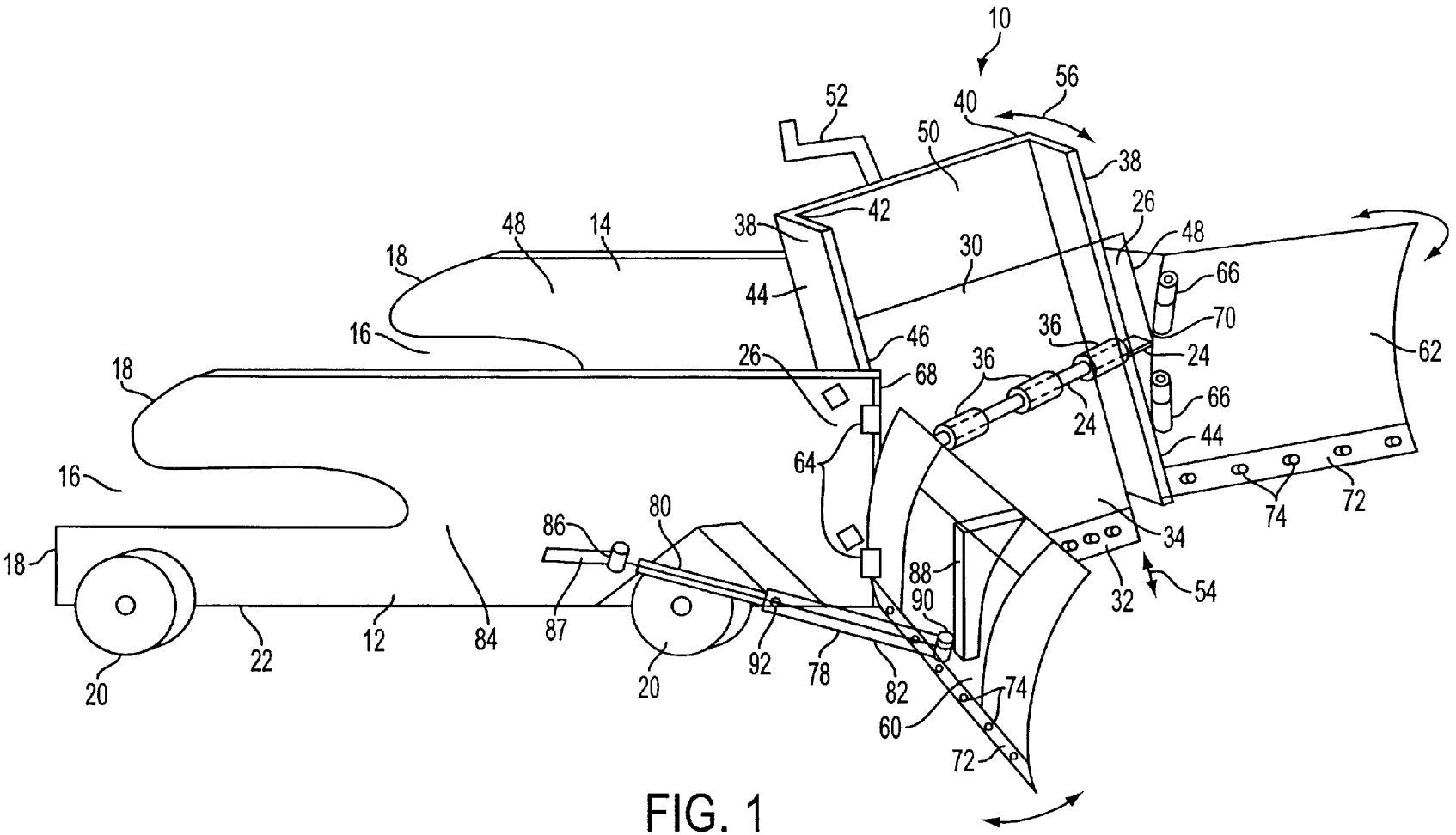
FIG. 1 is a schematic perspective view of a trench or road conditioning apparatus constructed in accordance with the invention.

The present invention will now be described in conjunction with the drawings, beginning with FIG. 1 which shows a road and trench conditioning apparatus 10 constructed in accordance with the invention. The apparatus 10 is designed to condition and level trenches formed in, for example, paved roads as well as to form a level surface on a layer of material extending below or above the road or other surface located laterally adjacent the apparatus.

Apparatus 10 includes a pair of parallel side walls 12, 14 which extend vertically and longitudinally fore and aft along the length of a trench or road surface. A rearwardly facing open slot 16 is formed in the rear face 18 of each side wall for receiving the bottom edge of a bucket or other similar shaped tool mounted on a power machine such as a backhoe or wheel loader. In this manner, the apparatus 10 can be lifted, propelled and maneuvered over a road or other surface to be conditioned by the apparatus.

Although wheels 20 are shown mounted along the lower edge 22 of each side wall 12, 14 in FIG. 1, the wheels can be replaced with skids, casters or other ground contact members as discussed below. The side walls 12, 14 are interconnected by several cross braces 24, one of which is shown welded between the front end portions 26 of each side wall 12, 14.

A central grading or leveling blade 30 is also mounted between the front end portions 26 of the side walls. The central blade 30 has a replaceable rectangular cutting edge blade 32 bolted to the bottom portion 34 of blade 30. Blade 30, as well as side walls 12, 14 can be formed of one inch thick steel plate to withstand the high loads experienced in trenching, paving and other road construction operations. The central blade 30 can be dimensioned as a rectangular or square plate. In one embodiment, the central blade is dimensioned as a square having 35 inch sides and the reversible cutting edge 32 is formed of ⅝ inch thick hardened steel plate, 6 inches wide and 34 inches long.

As further seen in FIG. 1, one or more rollers 36 are rotatably mounted on each cross brace 24 to support and position the central blade 30 in a fore and aft or longitudinal position. The central blade is provided with a pair of guide bars or guide members 38 which may be welded or otherwise rigidly fastened along the opposed, generally vertical side edges 40, 42 of the central blade 30. The guide members 38 may be formed of rigid steel plates having a flat outer surface 44 closely spaced apart from the inner flat wall surfaces 46, 48 of the front portion 26 of the side walls 12, 14.

The guide members 38 help to keep the central blade 30 centered in a trench such as a trench cut through a blacktop paved road surface. In addition, the guide members 38 add strength and rigidity to the central blade 30. It is also possible to dimension the guide members 38 to have planar sliding contact between the guide members 38 and the side walls 12, 14 to help to maintain the central blade 30 and plow blade 32 perpendicular to the longitudinal movement of the apparatus 10 along a trench or road surface. The guide members 38 are preferably affixed to project forwardly from and perpendicular to the front face 50 of the central blade 30 and may also extend and project rearwardly and perpendicularly with respect to the rear surface of the central blade 30.

The height of the central blade 30 may be adjusted vertically above or below the level of the surrounding road surface or other surface being worked. In the example of FIG. 1, this surface would be that over which wheels 20 roll. A jack screw, discussed further below, is operated with a crank 52 to raise and lower the central blade 30 in the direction of arrows 54. In addition, the slight inclination of the central blade 30 can be adjusted as shown by directional arrow 56 as further discussed below.

Apparatus 10 is further provided with one or a pair of side blades 60, 62 which are pivotally mounted on hinges 64, 66 to the front edges 68, 70 of one or each side wall 12, 14. Each side blade 60, 62 is provided with a reversible cutting edge or scraper blade 72 which may be removably and replacably mounted on the lower edge of each side blade with fasteners such as bolts 74.

Each side blade 60, 62 may be adjusted to a position in front of the central blade 30 and in front of the front edges 68, 70 of the side walls 12, 14. As shown in FIG. 1, this adjustment is provided by using a telescoping adjustment bar 78. Bar 78 includes an inner solid rod 80 which slides within an outer tubular rod or sleeve 82. The inner rod 80 is pivotally pinned to the outer surface 84 of the side wall 12 at pivot joint or hinge 86.

Mounting brackets 87 may be welded to the side walls to receive and support a pivot pin for pinning the hinge 86 to the side wall. The sleeve 82 is similarly pivotally pinned to the rear surface 88 of one or each side blade 60, 62 at a pivot joint or hinge 90. A removable pin 92 is used to adjust the length of the adjustment bar 78 by sliding into aligned bores formed through rod 80 and sleeve 82.

Figure 2:
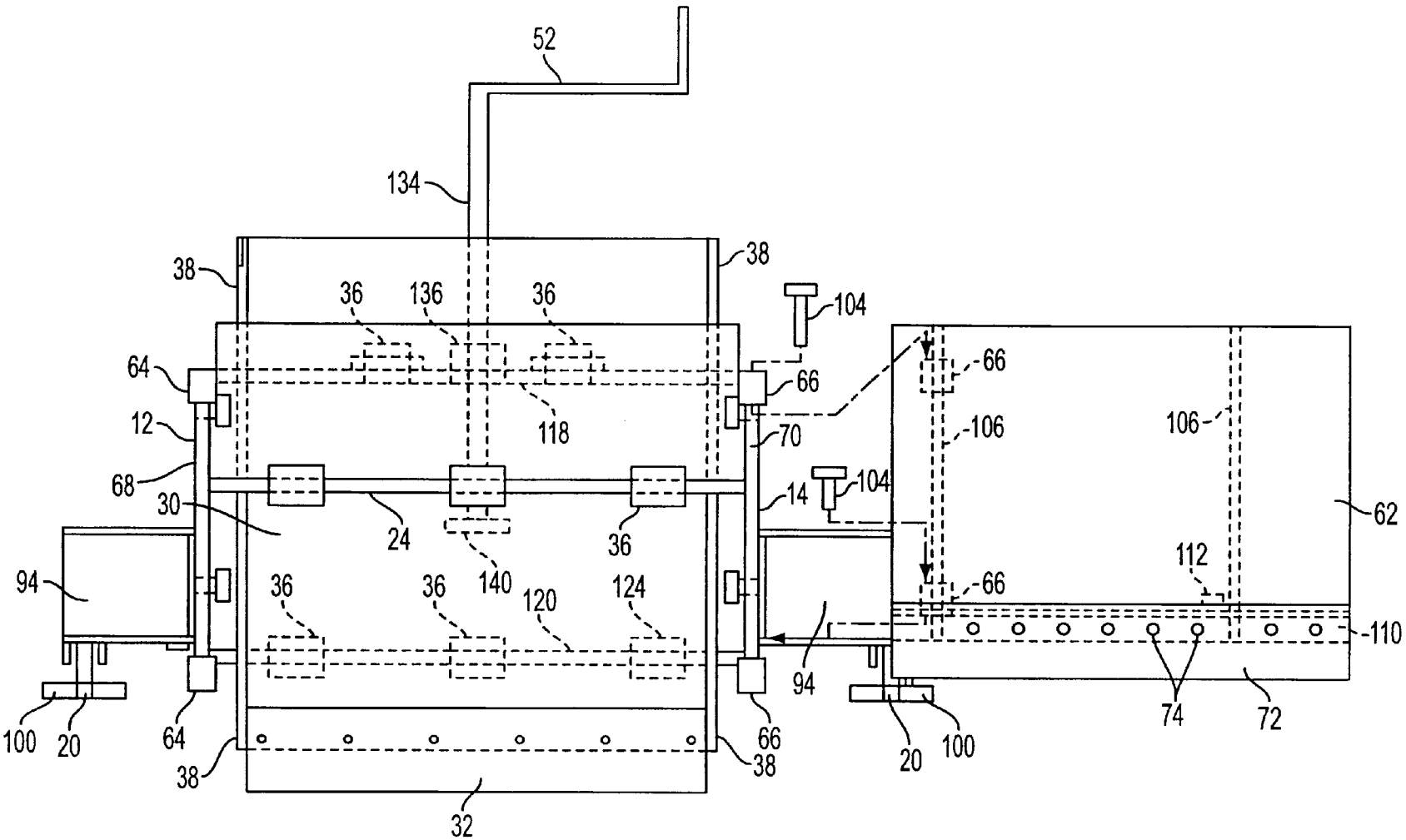
FIG. 2 is a front view of the apparatus of FIG. 1 with the side blades removed and showing the exploded assembly of one of the side blades on the apparatus.
Figure 3:
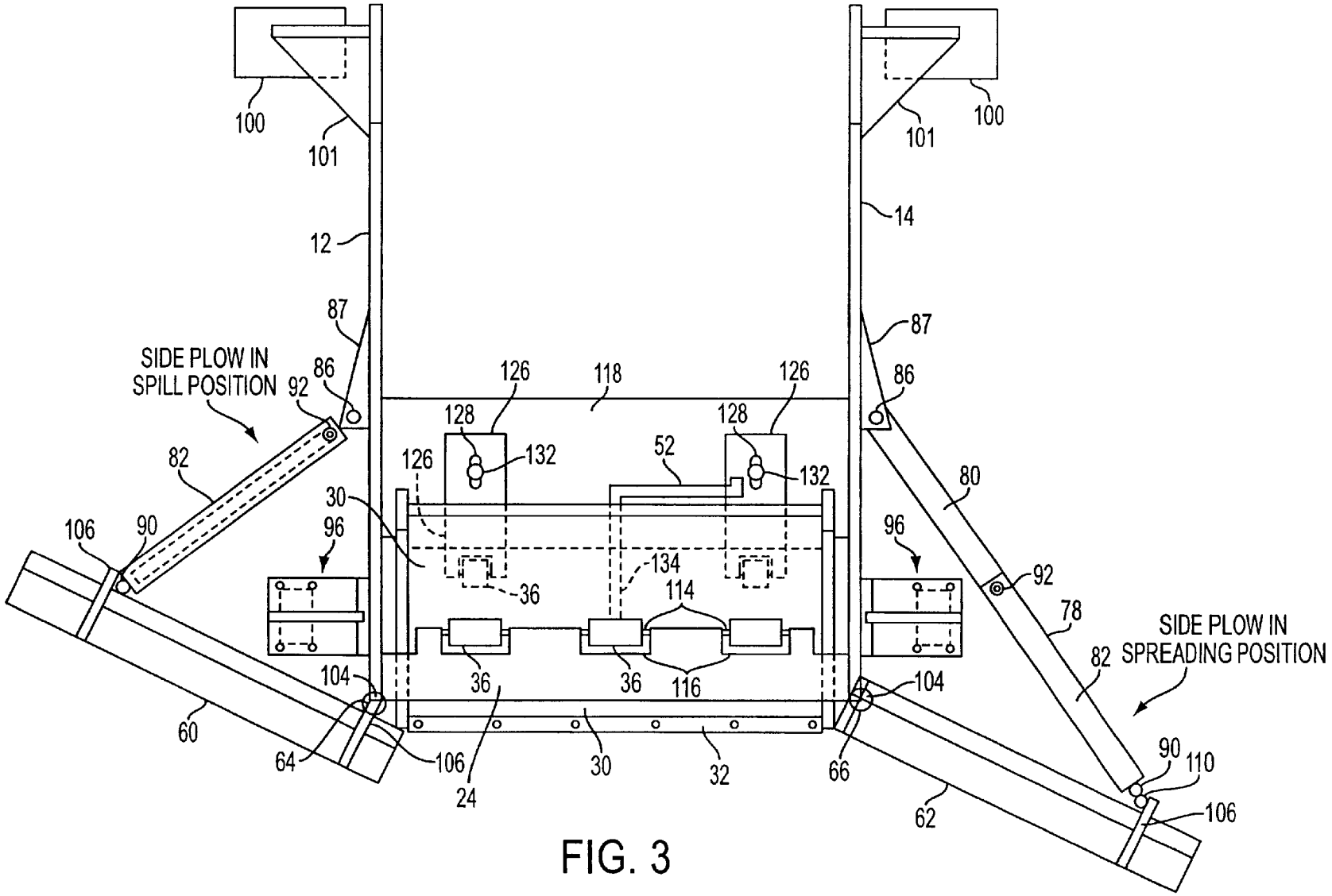
FIG. 3 is a top plan view of the apparatus of FIG. 2, with one side blade positioned in a rearward position and one side blade positioned in a forward position.
Figure 4:
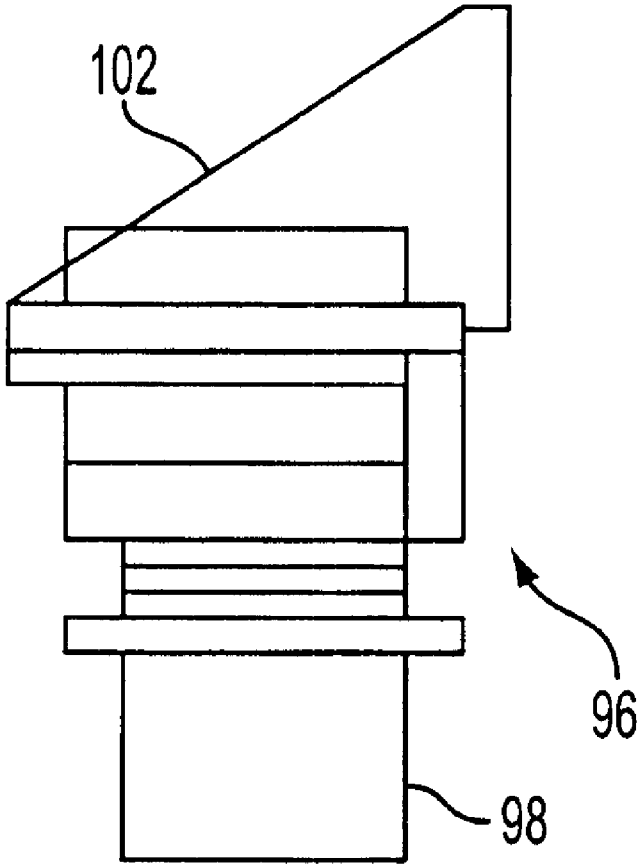
FIG. 4 is a front view of a caster assembly adapted for use with the invention.
Figure 5:
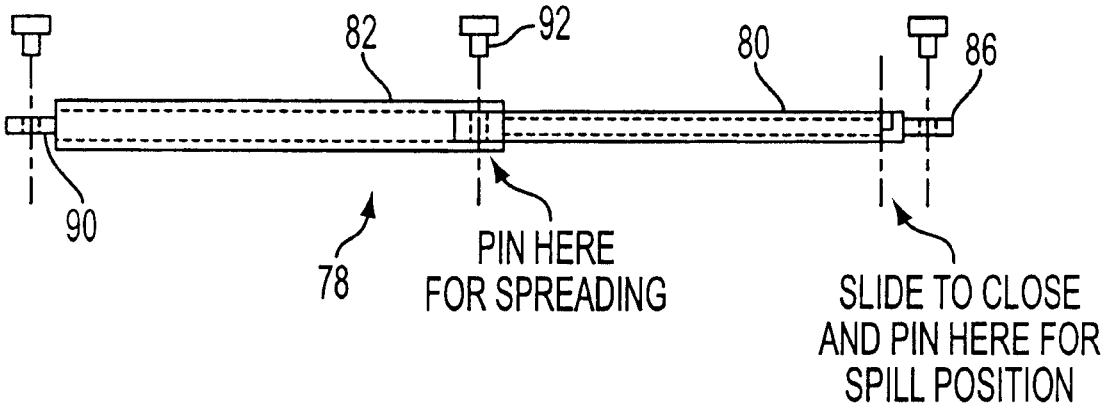
FIG. 5 is a front view of a side blade adjusting bar.

Additional details of the invention are seen in FIGS. 2 and 3. In these figures, the front wheels 20 of FIG. 1 are mounted to the side walls 12, 14 by cantilevered steel beams 94 which are welded and/or bolted to the side walls 12, 14. Alternatively, a caster assembly 96, such as shown in FIG. 4, can be used in place of the beam 94 and wheels 20. A skid plate 100 can alternatively be used in place of the rear wheels 20 as further seen in FIGS. 3 and 7. Each skid plate 100 is connected to each respective side wall 12, 14 with a steel bracket 101. The caster wheels 98 are connected to the side walls by a welded steel bracket 102 which is bolted in place on the side walls.

Figure 6:
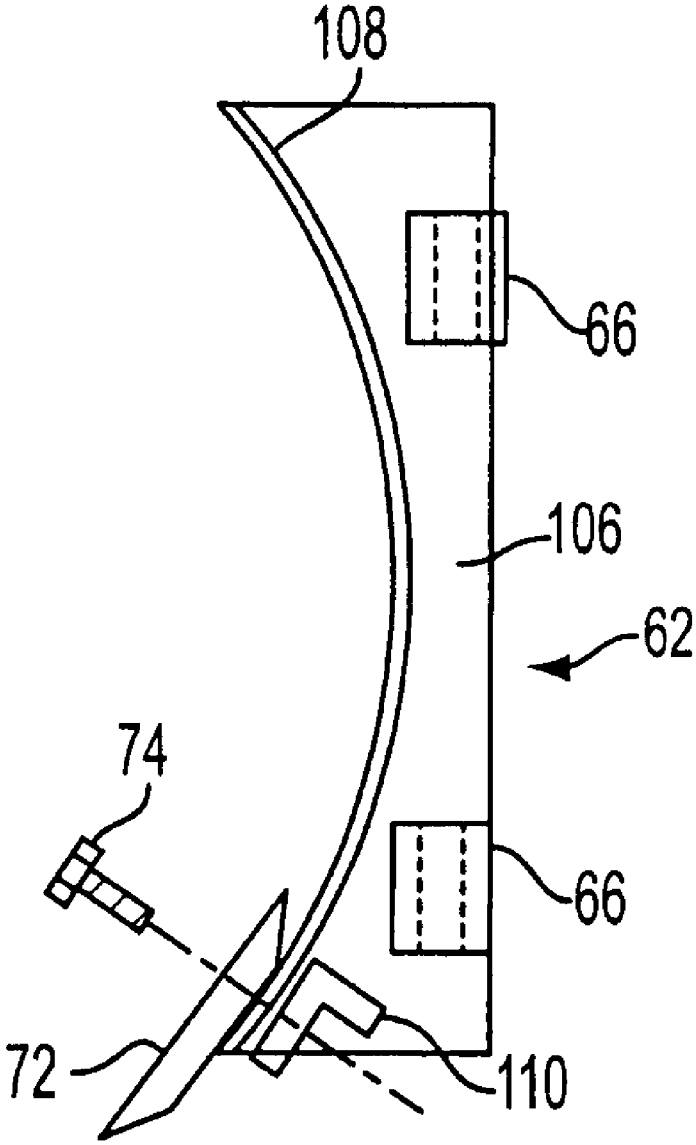
FIG. 6 is a side view of one of the side blades showing an inside support rib on which half hinges are mounted.

As further seen in FIG. 2, the side blade 62 is pinned to the half hinges 66 on side wall 14 by a pair of pivot pins 104. As seen in FIG. 6, the side blade 62 is reinforced with a pair of vertical steel ribs 106 welded to the rear surface 108 of side blade 62. An angled mounting bar 110 may also be provided on the rear surface 108 of the side blade 62. Bar 110 acts as an anchoring and strengthening surface into which bolts 74 may be threaded so as to clamp the plow blade 72 to the lower surface of the side blade 62.

While the central blade 30 is of a generally flat planar profile, the side blades 62 are advantageously curved or arcuate in side profile as seen in FIG. 6. One or both side blades 62 can be quickly and easily mounted or removed from the apparatus 10 by simple insertion or removal of pins 104 into or out of hinges 62, 66. A tubular hinge 112, as seen in FIGS. 2 and 3, is mounted by, for example, welding to the lower rear surface 108 of side blade 62 to form a pinned pivotal connection with the hinge 90 on the sleeve 82 of the adjustment bar 78.

As noted above, the central blade 30 is supported by a series of rollers 36 which contact the front face 50 of the central blade. These rollers, which are mounted on the front cross brace 24, hold the central blade against forward movement. The cross brace 24 may be a structural steel plate welded to and between the side walls 12, 14. Roller shafts 114 are mounted across recesses 116 cut in the rear edge of cross brace 24 to receive and support the rollers on the cross brace.

Figure 7:
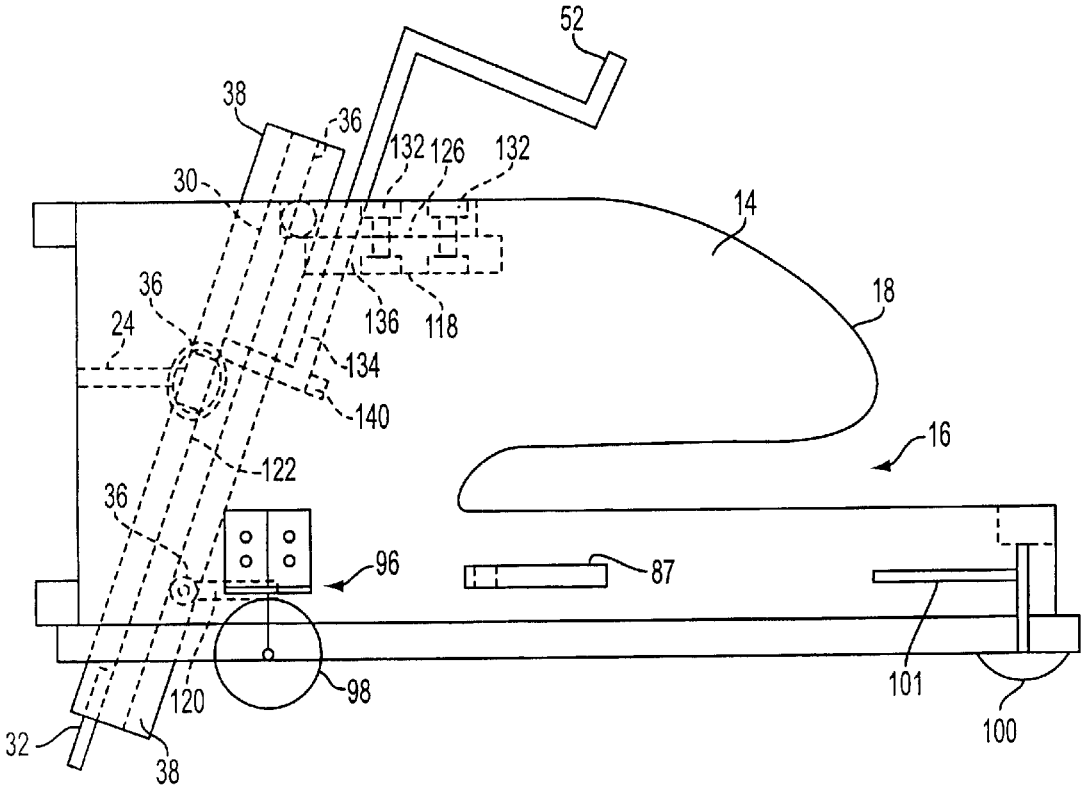
FIG. 7 is a side view of the apparatus of FIG. 1.

Two rear cross braces are mounted behind the central blade 30 as seen in dashed lines in FIGS. 2 and 7. A top rear cross brace 118, similar to cross brace 24, is welded or otherwise connected across and to the top portion of side walls 12, 14 and a similar lower or bottom rear cross brace 120 is welded or otherwise connected across and to the bottom portion of side walls 12, 14. One, and preferably two, three or more rollers 36 are mounted in a coaxially-spaced series across the front edge of the top and bottom rear cross braces 118, 120.

While the rollers 36 on the bottom rear cross brace 120 are preferably fixed in position against the rear surface 122 of the central blade 30 and mounted directly to the bottom rear cross brace on shafts 124, the rollers 36 on the top rear cross brace 118 are longitudinally adjustable back and forth to provide for an adjustment in the for and aft inclination of the central blade 30 and to adjust the fit and pinch on the central blade between all of the rollers 36 on each cross brace. This adjustment is provided by a pair of adjustable mounting plates 126. Each mounting plate 126 includes a longitudinal slot 128 which allows each mounting plate to slide forward and backward on top of the top rear cross brace 118. Fasteners such as bolts 132 may be loosened and tightened as desired to allow the mounting plates 126 to be moved and locked in position as desired.

It can be appreciated that the central blade 30 is securely captured between the rollers 36 on the front central brace 24, and the rollers 36 on the top and bottom rear cross braces 118, 120. The rollers 36 not only support and fix the central blade at a desired inclination, they also allow the central blade to be easily rolled up and down against the rollers to adjust the height of the plow blade 32 either below, at or above the surrounding road surface.

This vertical adjustment is provided with a threaded jack screw 134 attached to the crank handle 52. The jack screw 134 is axially fixed in a rotatable bearing 136 mounted on the top rear cross brace 118. The lower threaded end of the jack screw 134 is threaded into a threaded bore formed in a steel plate 140 welded to the upper central portion of the rear surface 122 of the central blade 30. Plate 140 is preferably located between the top and bottom cross braces 118, 120.

When the crank handle 52 is turned one way or another, the central blade 30 is raised or lowered independently of the side blades 60, 62. When the central blade 30 is lowered below the side blades, the apparatus 10 acts as a trench leveler or spreader, and when the central blade is raised above the side blades the apparatus 10 acts as a spreader.

As seen in FIG. 3, the side blade 60 is adjusted to a position in back of the central blade 30 so as to plow earth or other road materials laterally outwardly away from the central blade. The other side blade 62 is adjusted to a position in front of the central blade 30 so as to plow earth or other road materials laterally inward toward the central blade. Of course, both side blades 60, 62 may be adjusted forwardly or rearwardly as desired, depending on the desired operation. In either case, earth and material is cleared from the path of the wheels, casters and skids.

The lower edges of the scraper blades 72 on the side blades 60, 62 typically scrape over the adjacent surfaces of a paved road as the plow blade 32 on the central blade 30 levels a recessed trench dug beneath the adjacent paved road surfaces. This keeps the adjacent paved road surfaces clean. Alternatively, the central blade can be raised above the adjacent paved road surfaces to level a layer of aggregate or blacktop above these adjacent surfaces. In this case, the scraper blades also keep the adjacent road surfaces free of the aggregate, blacktop or other material being spread and leveled.

There has been disclosed heretofore the best embodiment of the invention recently contemplated. However, it is to be understood that the various changes and modifications may be made thereto without departing from the spirit of the invention.

What is claimed is:

1. An apparatus for leveling road materials and earth, comprising:

a first side wall and a second side wall;

a plurality of cross braces interconnecting said first and second side walls;

a central blade mounted between said cross braces;

at least one side blade mounted to one of said first and second side walls; and an adjustment assembly provided on said central blade that adjusts said entire central blade up and down independently of said at least one side blade.

2. The apparatus of claim 1, further comprising at least one roller respectively mounted on said cross braces and engaged with said central blade.

3. The apparatus of claim 1, further comprising a mounting slot formed in each of said first and second side walls for mounting said apparatus to a power machine.

4. The apparatus of claim 1, wherein said adjustment assembly comprises a manually actuated screw.

5. The apparatus of claim 1, wherein said central blade comprises a front surface and a rear surface and wherein said plurality of cross braces comprises a front cross brace extending in front of said front surface and a pair of rear cross braces extending in back of said rear surface.

6. The apparatus of claim 1, wherein said at least one side blade is movable forward and rearward of said central blade.

7. The apparatus of claim 1, further comprising an adjustment member pivotally mounted to one of said side walls and to said at least one side blade for selectively fixing said side blade forward and rearward of said central blade.

8. The apparatus of claim 1, further comprising a pair of side blades respectively pivotally mounted to said first and second side walls on opposite sides of said central blade.

9. The apparatus of claim 1, wherein said adjustment apparatus comprises a manually actuated member connected to one of said cross braces and to said central blade.

10. The apparatus of claim 1, further comprising an adjustment plate mounted on one of said cross braces and movable toward and away from said central blade.

11. The apparatus of claim 1, wherein said central blade comprises a flat planar plate.

12. The apparatus of claim 1, further comprising a pair of planar guide members mounted on opposite sides of said central blade for guiding said central blade in a trench.

13. The apparatus of claim 1, further comprising a pair of skid members respectively mounted to said first and second side walls.

14. The apparatus of claim 1, further comprising a pair of rolling members respectively mounted to said first and second side walls.

15. A leveling apparatus attachable to a backhoe or wheel loader, comprising:

a pair of side walls;

a plurality of braces interconnecting said side walls;

a central blade having a front surface and a rear surface and mounted between said side walls;

an adjustment assembly mounted on said apparatus for driving said central blade up and down between said side walls; and a first support member located between said side walls and engaging said front surface of said central blade and a second support member located between said side walls and engaging said rear surface of said central blade.

16. The apparatus of claim 15, wherein said first support member comprises a roller.

17. The apparatus of claim 16, wherein said roller is mounted on one of said braces.

18. The apparatus of claim 15, further comprising at least one side blade movably mounted to one of said side walls.

19. The apparatus of claim 15, wherein said adjustment assembly comprises a screw.

* * * * *